US006705856B1

(12) United States Patent
Toueix et al.

(10) Patent No.: US 6,705,856 B1
(45) Date of Patent: Mar. 16, 2004

(54) LIGHTER FOR GENERATING A FLAME OF CONTROLLED COLOR

(75) Inventors: Daniel Toueix, Ivry-sur-Seine (FR); Jean-Pierre Rives, Paris (FR)

(73) Assignee: Rivonia Trading LDA, Fanchal (PT)

( * ) Notice: Subject to any disclaimer, the term of this patent is extended or adjusted under 35 U.S.C. 154(b) by 0 days.

(21) Appl. No.: 09/720,815

(22) PCT Filed: Jul. 2, 1999

(86) PCT No.: PCT/FR99/01593

§ 371 (c)(1),
(2), (4) Date: Feb. 23, 2001

(87) PCT Pub. No.: WO00/01988

PCT Pub. Date: Jan. 13, 2000

(30) Foreign Application Priority Data

Jul. 3, 1998 (FR) ..... 98 08530

(51) Int. Cl.[7] ..... F23D 14/28; F23Q 2/34

(52) U.S. Cl. ..... 431/344; 431/126; 431/350; 431/277

(58) Field of Search ..... 431/344, 126, 431/350, 353, 354, 170, 7, 4, 243, 254, 276, 277, 150

(56) References Cited

U.S. PATENT DOCUMENTS

| | | | | | |
|---|---|---|---|---|---|
| 3,072,151 | A | * | 1/1963 | Quercia | 431/131 |
| 3,125,153 | A | * | 3/1964 | Lindgren | 431/344 |
| 3,414,363 | A | * | 12/1968 | Rosfelder | 431/255 |
| 3,468,615 | A | * | 9/1969 | Carey | 431/126 |
| 3,709,462 | A | * | 1/1973 | Piffath et al. | 431/344 |
| 4,416,613 | A | * | 11/1983 | Barisoff | 431/353 |
| 4,895,511 | A | * | 1/1990 | Schmid | 431/126 |
| 5,716,204 | A | * | 2/1998 | Mifune et al. | 431/344 |
| 5,984,669 | A | * | 11/1999 | Rosada et al. | 431/126 |
| 6,036,478 | A | * | 3/2000 | Inada | 431/344 |

FOREIGN PATENT DOCUMENTS

| | | | |
|---|---|---|---|
| FR | 2 650 876 A | * | 2/1991 |
| JP | 58 104426 | | 6/1983 |
| JP | 63-58021 A | * | 3/1988 |
| JP | 10-19255 A | * | 1/1998 |
| WO | 95/15464 | | 6/1995 |

* cited by examiner

*Primary Examiner*—Josiah Cocks
(74) *Attorney, Agent, or Firm*—James R. Williams

(57) ABSTRACT

The present invention relates to a lighter for generating a flame of controlled color, the lighter being of the type comprising a tank (20) adapted to receive a fuel (30) associated with flame coloring agents, expander means (40) suitable for expanding the fuel (30), means (50) suitable for conveying the fuel (30) to the expander means (40), and means (60) suitable for igniting the fuel (30) downstream from the expander means (40), the lighter being characterized by the fact that the expander means (40) are formed by an element that is hydrophobic, organophobic, and inorganophobic.

27 Claims, 7 Drawing Sheets

FIG.1
PRIOR ART
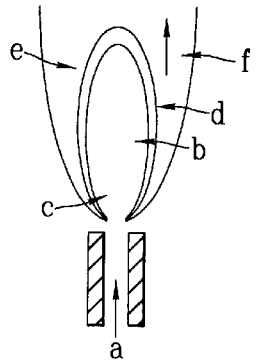
FIG.2
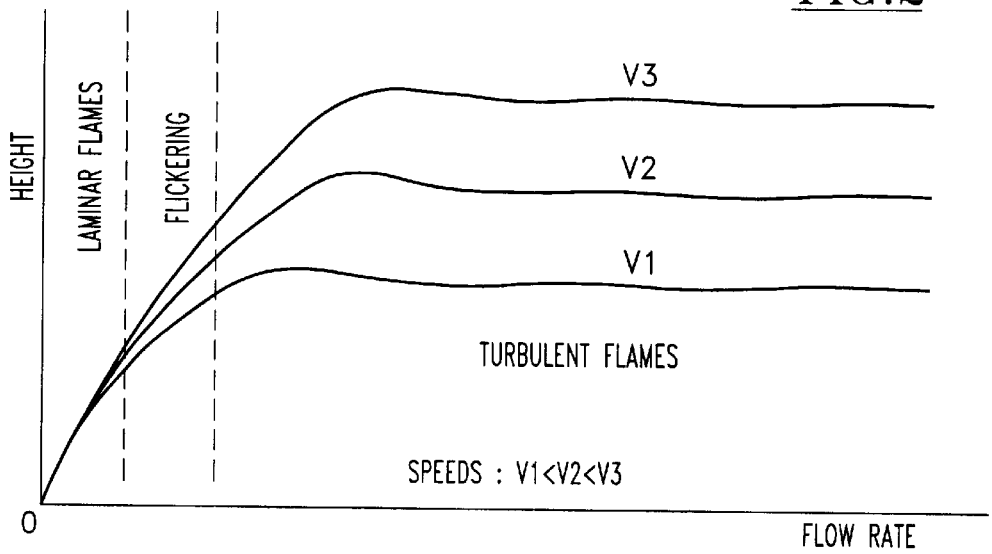
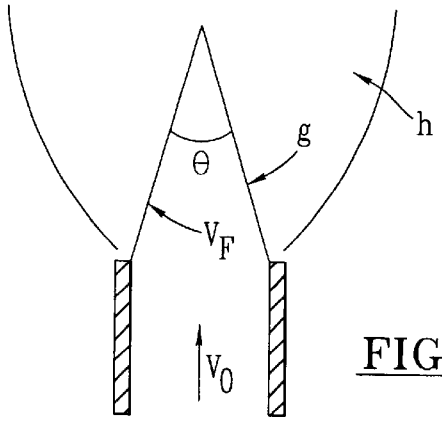
FIG.3

60
82
62
66
45
80
74
64
72
70
40
76
30
50
10
20

LIGHTER FOR GENERATING A FLAME OF CONTROLLED COLOR

REFERENCE TO PRIOR FILED APPLICATIONS

This application is a request for continued examination of U.S. Ser. No. 09/720,815 filed under 35 USC 371 on Feb. 23, 2001.

FIELD OF THE INVENTION

The present invention relates to the field of lighters, and more particularly lighters designed to generate a flame of controlled color.

BACKGROUND OF THE INVENTION

Examples of work undertaken in the past in this field can be found in document WO 95/15464.

SUMMARY OF THE INVENTION

An object of the present invention is to propose a novel means enabling the performance of colored-flame lighters to be improved.

A particular object of the present invention is to propose a lighter that generates a flame of durable stability.

These objects are achieved in the present invention of by means of a lighter of the type comprising a tank adapted to receive a fuel associated with flame-coloring agents, expander means suitable for expanding the fuel, means suitable for conveying the fuel to the expander means, and means suitable for igniting the fuel downstream from the expander means, the lighter being characterized by the fact that the expander means are formed by an element that is hydrophobic, organophobic, and inorganophobic.

BRIEF DESCRIPTION OF THE DRAWINGS

Other characteristics, objects, and advantages of the present invention will appear on reading the following detailed description with reference to the accompanying drawings given as non-limiting examples and in which:

FIG. 1 is a diagram showing the appearance of a laminar-diffusion flame;

FIG. 2 shows how the height of a flame and varies as a function of fuel flow rate and speed;

FIG. 3 is a diagram showing the appearance of a pre-mixed flame;

DETAILED DESCRIPTION OF THE INVENTION

Figure 4:
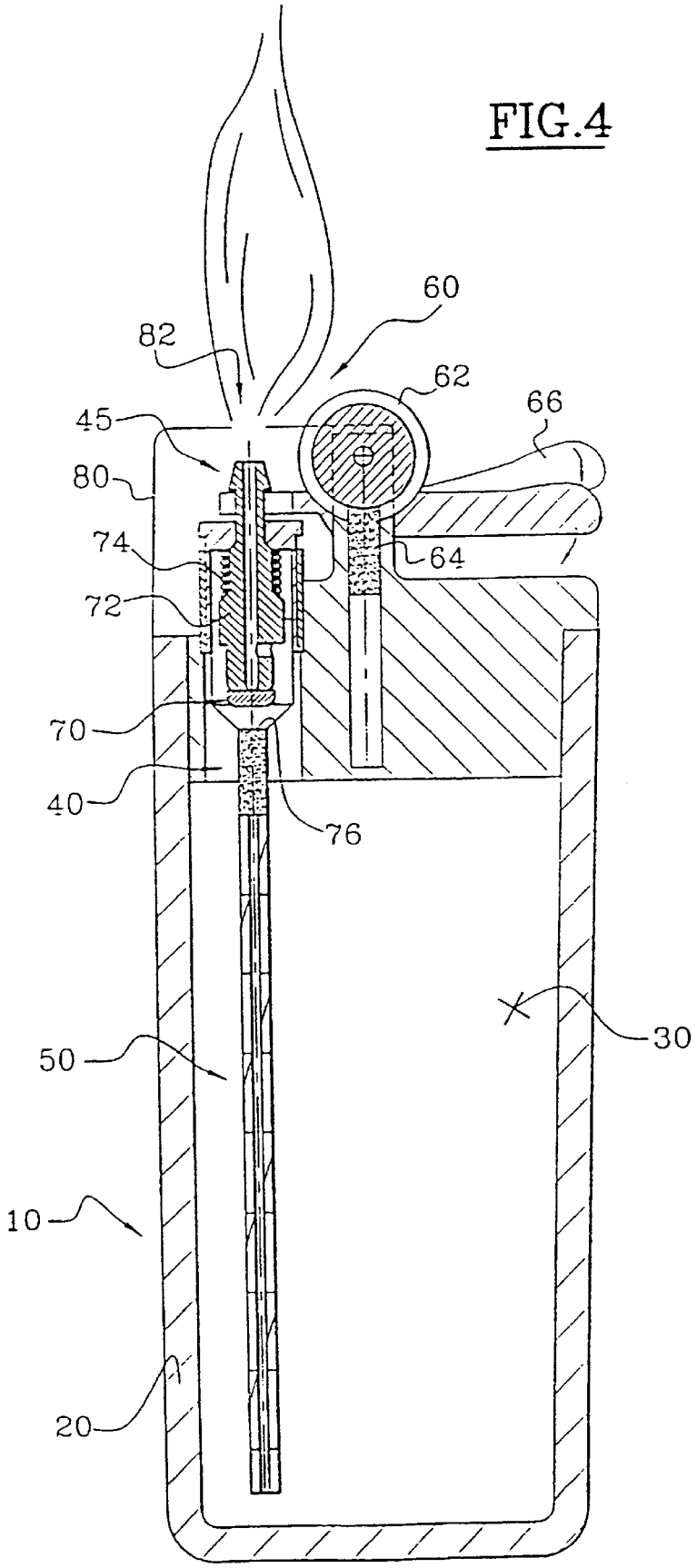
FIG. 4 is a diagrammatic view of a colored flame lighter in accordance with the present invention.

The present invention is the outcome of lengthy studies on lighter flames, which studies have led to the following observations.

Diffusion flames are characterized by the fact that the fuel and the oxidizer are not mixed before reaching the zone where they burn. Conventional lighter and candle flames are typical examples of diffusion flames. The phenomena that are important with these flames are phenomena whereby molecules of oxygen diffuse from the air towards the center of the flame, and fuel molecules diffuse out from the center of the flame towards its periphery; those phenomena govern the shape and the behavior of such flames.

In contrast, when the fuel and the oxidizer are mixed before reaching the reaction zone, then the flame is a pre-mixed flame.

Diffusion flames are often stabilized at the outlet from a cylindrical tube. If the flow of gaseous fuel at the outlet is slow enough to avoid creating turbulence, then the flame is said to be laminar. The usual shape of such a flame is shown in FIG. 1.

FIG. 1 is a diagram showing:

a) the flow of gaseous fuel at the outlet from a tube;
b) soot which shines yellow;
c) diffusion of the fuel;
d) a bluish reaction zone;
e) diffusion of oxygen; and
f) burnt gas accelerated by natural convection (naturally not visible).

The most commonly visible portion is a yellow zone b which is outlined bey a bluish boundary d. This bluish thickness d does not emit much light compared with the yellow-colored zone b. This combination is surrounded by a layer constituted by hot burnt gas f which rises mainly under drive from natural convection. The hot gas is generally not visible.

The yellow portion b is characteristic of the presence of carbon, known as "soot" in the language of the person skilled in the art of combustion. The soot is formed by carbon-containing molecules decomposing in the fuel under the action of heat. In this zone, oxygen is at less than stoichiometric quantity. Combustion is poor. On approaching the reaction zone, this soot is raised to a high temperature and emits a yellow-orange light, thus causing the flame to shine. The soot then burns on passing through the reaction zone d, and in general it disappears. The hottest zone corresponds to the reaction zone d which is blue in color. The major chemical reactions take place in this zone and that is where heat is given off. It corresponds more or less to the location where the fuel is mixed in stoichiometric proportion with oxygen. Mixture can take place in this location only by the diffusion of molecules: the fuel which is located on the axis of the burner diffuses towards the bluish lateral zone d, and the oxygen which is present in the outside air also diffuses laterally to feed the zones in which it is not present initially.

Chemical reaction between the fuel and oxygen from the air gives rise to burnt gas (mostly $CO_2$ and water vapor), and to a very large amount of heat being given off, thereby raising the gas to high temperatures, of the order of 1700° C. at the top. The burnt gas f is quickly removed upwards under drive from natural convection. It is not visible naturally and it is necessary to use special visualization techniques in order to make it show up: the shadow graphic method, the schlieren method, tomography, etc.

If the fuel contains an additive suitable for shining or ionizing at high temperature, then it will appear in the bluish zone d. Its ionization or its chemiluminescence can last for a length of time that is sufficient for it to continue to be colored while passing through the burnt gas f.

In order for burning to be complete in the blue zone d, the mass $Q_F$ of fuel that meets a mass $Q_{OX}$ of oxygen must be such that the stoichiometric equation is satisfied, i.e.:

$$Q_{OX}=S.Q_F \quad (1)$$

where s is the stoichiometric coefficient. s is 4 for methane and 3.59 for butane.

Oxygen has to diffuse laterally from the outside air towards the bluish zone through a layer of burnt gas that is of thickness δ, where δ depends on height. To a first approximation, the oxygen diffusion flow rate can be written as follows:

$$\Phi_{OX} = D_{OX}\frac{\rho_0}{\delta} \tag{2}$$

where $D_{OX}$ is the diffusion coefficient of oxygen through the layer of burnt gas and $\rho_0$ is the density of the outside air.

By matching the lateral diffusion time with the convection time in the burnt gas, the width of the burnt gas is obtained:

$$\delta \approx D_{OX}^{1/2}\left(g\frac{\rho_0\rho_b}{\rho_b}\right)^{-1/4} z^{1/4} \tag{3}$$

where g is the acceleration due to gravity, $\rho_b$ is the density of the burnt gas, and z is height starting from the burner. It should be observed that acceleration in the burnt gas can be as great as five or six times the acceleration due to gravity.

Assuming that the flame is large and that the reaction zone is in the form of a very elongate cylinder, and by using the three equations (1 to 3), it is possible to determine the length of the flame that is required to burn all of the fuel injected. This gives:

$$L = \frac{Q_F}{2\pi\rho_F D_F} \tag{4}$$

This relationship is most advantageous. It gives the top boundary of the blue zone, which is very close to the top boundary of the yellow zone. Length is proportional to the mass flow rate of the fuel, and it is inversely proportional to the density of the fuel and to the diffusion coefficient of the fuel $D_F$. A remarkable point is that this formula is independent of the diameter of the burner.

Beyond a certain flow rate corresponding typically to a height of 4 cm or 5 cm, flames are no longer a stable. They start oscillating vertically at a frequency of about 15 Hertz. Flames become longer and shorter periodically, oscillating with an amplitude of 1 cm or 2 cm. Such flames are said to be "flickering". Oxygen delivery is improved and mean flame length is no longer linear with flow rate. At flow rates that are higher still, flames become turbulent, i.e. the jet at the outlet from the tube is too fast to remain laminar. Such flames are turbulent and the paths followed by the gas are highly disordered, even though the mean direction remains parallel to the axis of the tube. These turbulent stirring movements enhance mixing between fuel and oxygen; in other words molecules meet one another more quickly. At a given flow rate, this gives rise to a flame of constant height. However, under turbulent conditions, the height of the flame depends on outlet speed.

FIG. 2 shows how flame height varies as a function of fuel flow rate and speed.

Under turbulent conditions, a higher delivery speed gives a flame of that is longer, however in general this cannot be observed with lighters since flames need to be several tens of centimeters high before entering fully into turbulent conditions.

As soon as flow rates become high, and particularly when delivery speeds are high, another phenomenon appears: the flame becomes unstuck or "lifts off". The base of the flame becomes detached from the outlet of the tube and stabilizes at a distance therefrom. When speeds become much too large, the flame goes off a long way: it is blown away.

It has been found that flames lift off was soon as outlet speeds reach 7 metros per second (m/s) to 8 m/s. Lift-off distance varies regularly with speed and it is possible to reach several tens of centimeters at high speeds. Such flames are turbulent and often noisy. The flow rates and speeds are such that the flames are constrained remain on the axis and they are very insensitive to the effects of natural convection. It should be observed that "lifted" flames enable fuel to mix with air to some extent before burning, thus having a pre-mixed base portion. This gives rise to better combustion, and in particular to a less soot being produced. Thus, the yellow portion shines less brightly at the base of the flame and blue dominates.

The present invention proposes reducing the lift-off distance or keeping flames attached longer by using a cap having a certain height with an orifice above the outlet of the nozzle.

Unlike diffusion flames, pre-mixed flames are characterized by the fact the fuel and the oxygen are mixed before reaching the outlet of the burner. Premixing takes place at a certain ratio which is known as richness. A richness of 1 corresponds to stoichiometric mixing, i.e. the fuel and the oxygen are in ideal proportions for complete reaction. If the mixture contains too much oxygen, then the flame is said to be "poor" in fuel and its richness is less than 1. Conversely, a flame is said to be "rich" when there is too much fuel; its richness is then greater than 1.

If mixing is performed in a tube and the mixture is lit at one end, then the flame propagates at constant speed. Typically the deflagration speed of a methane-air flame with a richness of 1 is 0.40 m/s.

The behavior of pre-mixed flames is completely different from that of diffusion flames. On approaching stoichiometric conditions, flame height depends both on delivery speed and on flame propagation speed. There must be equilibrium between the normal speed of the gas reaching the flame front and the propagation speed of the flame $V_F$ (see FIG. 3, in which reference g designates a pale blue reaction zone, and reference h designates burnt gases that are very difficult to see).

This can be written as follows: $V_F = V_0 \sin(\theta/2)$. Thus, if $V_0$ increases, the flame angle decreases and the flame is taller. The same applies if the flame propagation speed decreases. The propagation speed depends on the composition of the mixture, but it passes through a maximum near stoichiometry; i.e. for a fixed delivery speed, the flame becomes shorter as the mixture comes closer to stoichiometry.

Pre-mixed hydrocarbon flames generally burn with a pale blue color. They only begin to emit yellow soot when the mixture is rich in fuel (too poor in oxygen).

Accompanying FIG. 4 is a diagram showing the general structure of a lighter in accordance with the present invention.

It is adapted to perform two-phase combustion.

FIG. 4 shows a lighter 10 which comprises a tank 20 adapted to receive a fuel 30 associated with flame-coloring agents, expander means 40 suitable for expanding the fuel 30, means 50 suitable for conveying the fuel 30 to the expander means 40, and means 60 suitable for igniting the fuel 30 on leaving the expander means 40.

Naturally, the lighter 10 also has means 70 forming a valve suitable for controlling the time during which the fuel 30 is released.

The means 40 perform two functions: they constitute a static mixer and they serve as an expander for the fuel and the coloring agent associated therewith.

As mentioned above, in the present invention the expander means 40 are formed by an element having no adsorption capacity, and thus more precisely an element which is hydrophobic (no capacity to absorb water), organophobic (no capacity to absorb organic molecules), and inorganophobic (no capacity to absorb inorganic molecules).

It can be a simple nozzle of calibrated dimensions, or it can be a grid, e.g. a metal grid.

However, in the present invention, it is preferable for the expander means 40 to be made of a porous material.

The use of an element which is hydrophobic, organophobic, and inorganophobic as recommended in the context the present invention makes it possible to avoid any condensation taking place on the element when the valve 70 is opened and expansion occurs.

The work on which the invention is based has shown that condensation constitutes a major drawback of previously-known devices. Experiments performed on known systems have revealed that they frequently present irregularities in operation in the form of flow rate instability, particularly while the tank is being filled or when the pressure in the tank is expanding a great deal. It has been shown that these phenomena are generally due to the hydrophilic properties of the expansion elements proposed in the past. It would appear that the moisture absorbed by conventional ceramics can freeze during a drop in temperature and consequently disturb fuel delivery. Similarly, phenomena have also been observed whereby molecules of the solvent and of the coloring agent salt are retained by the polar material of the filter.

Still more precisely, in the present invention, it is preferable for the expander means 40 to be made of a thermoplastic polymer material. More preferably still, the means 40 are non-polar.

Thus, materials that are suitable for use in making the element 40 in the context of the present invention include in particular: fluorine-containing polymers such as polytetrafluoroethylene (PTFE); and polyolefins such as polyethylene (PE), and in particular high-density polyethylene.

The expansion-controlling element 40 made of these polymer materials can be made by sintering or by dissolution.

Making a polymer structure by sintering is well known to the person skilled in the art and is therefore not described below.

Working by dissolution consists essentially in making a mixture based on polymer and a solid filler, in extruding and forming a film by means of the mixture, and in dissolving the filler by material that is not a solvent for the polymer matrix. Finely-divided colloidal silica, salt grains, or equivalent means can be used as "fillers". It is also possible to add wetting agents such as sodium dodecyl benzene sulfonate.

A variant of the dissolution method can use a polymer of a kind that is different from that of the matrix instead of using a solid filler. The different polymer is then extracted by means of a solvent.

Nevertheless, the present invention is not limited to these techniques of sintering or dissolution.

For example, in the context the present invention, it is also possible to envisage using any of the following techniques:

- a "dry" process in which the polymer passes through various steps: solvent evaporation; gel formation; gel contraction; and final drying;
- a "wet" process in which, for example, either 1) the solution containing the polymer is partially evaporated and then immersed in a non solvent in a gelling bath, with the porous membrane forming by exchange between the solvent and the non solvent (the non solvent penetrates into the polymer), or else. 2) the solution containing the polymer is immersed directly in the non solvent, exchange then takes place between the solvent and the non solvent, and the membrane is formed;
- a "thermal" process in which a latent solvent is used, i.e. a substance which acts as a solvent at high temperature and as a non solvent at lower temperature;
- a dense swollen element: a dense element is immersed in a "swelling" system and then the system is exchanged with a non solvent medium;
- a stretched semi-crystalline element: this technique makes it possible to obtain membranes having pores of very small diameter, about 0.2 microns ($\mu$m); in this context, it is possible for example, to mix highly crystalline polytetrafluoroethylene of fibrous structure with a lubricant such as naphtha and to extrude the mixture. The lubricant is then eliminated by heating. The resulting sheets are calendered so as to obtain appropriate thicknesses, stretched, and then possibly sintered; or indeed the expander element 40 can be made by polymerization.

The porous material forming the expander element 40 typically possesses a pore size of about one micron at most.

This pore size is well adapted to generating fine droplets in the flame zone, i.e. to achieve nebulization of the fuel/coloring agent mixture.

According to another a advantageous characteristic of the present invention, the expander means 40 are adapted to control the flow rate of fuel and associated coloring agent upstream from the flame point to lie in the range 2 m/s to 8 m/s.

Also in the context of the present invention, the lighter 10 is preferably fitted downstream from the fuel outlet with a cap that is given reference 80 in FIG. 4. The cap has an orifice 80 of calibrated size placed in register with the above-mentioned fuel outlet so as to reduce the outlet speed of the fuel and thus avoid the flame blowing away, thereby stabilizing the flame.

In another advantageous characteristic of the present invention, the means 50 for conveying fuel 30 comprise, upstream from the flame point, a venturi effect pump 100 (or "suction" generator) suitable for controlling the amount of oxygen supplied so as to obtain the stoichiometric ratio and optimize combustion. The converging portion 122 of the jet pump is fed with fuel coming from the tank 20. This prevents poor combustion of the fuel 30 generating a disturbing color and enables the coloring agent to produce its effect to the full. Such a venturi effect pump delivers air to the base of the burner, which enables premixing to start, which in turn ensures that soot is oxidized very quickly.

In the present state of our investigations, it is considered that causing the venturi effect pump to deliver about one 10th of the oxygen flow required for total combustion represents an advantageous compromise which produces a flame with practically no soot and with a length that is equivalent to a pure diffusion flame, i.e. a flame at that does not lift off.

Embodiments of such venturi effect pumps are described below.

It has been found that the means of the present invention as described above make it possible simultaneously to generate a flame that that is stable, that is connected to the outlet of the fuel delivery means, and that does not possess any intrinsic parasitic color. Consequently, this enables the coloring agents to be expressed in full. Thus, by means of the present invention, it is possible to limit the quantity of coloring agent and associated solvent that needs to be introduced into the tank 20 for the purpose of obtaining given coloration.

In the present invention, the fuel 30 is advantageously butane. This is stored in the liquid state in the tank 20.

The coloring agent is advantageously mixed with the fuel while in solution in a solvent, preferably an alcohol, such as methanol or ethanol. The coloring agent itself can be implemented in numerous ways. For example, it can be a metal salt, or an alkali metal, or a derivative of boric acid, or an oxide of an alkali metal. Document WO 95/15464 describes compositions of coloring agents suitable for use in the context of the present invention.

The tank 20 for receiving the fuel 30 and the flame coloring agent can be embodied in many ways. Its structure is therefore not described in detail below.

The means 50 for conveying fuel 30 to the expander means 40 can likewise be embodied in numerous ways. In the present invention, these means 50 are advantageously constituted by a capillary tube. It typically has a diameter lying in the range 0.2 mm to 0.9 mm.

Also, as shown diagrammatically in FIG. 4, it is preferable to provide an outlet nozzle 45 downstream from the valve 70 and the expander means 40. The outlet diameter of the nozzle 45 is typically about 0.33 mm.

The valve 70 can be provided upstream or downstream from the expander means 40.

The means 60 for igniting the fuel 30 at the outlet from the expander means 40 can be implemented by any suitable known means, for example igniter means based on a piezoelectric element, or on a fiction system of the kind comprising a wheel 62 and a flint 64 (as shown in FIG. 4).

The means 68 are preferably controlled by actuating a lever 66 hinged to pivot on the lighter 10. In conventional manner, the lever 66 also serves as means for controlling the valve 70. For example, as shown diagrammatically in FIG. 4, it is possible for the lever 66 to be connected via a fork or equivalent means to a bushing 72 which carries the outlet nozzle 45. A spring 74 urges the bushing 72 against a valve seat 76. Thus, at rest, the bushing 72 bears against the seat 76 and forms a closed valve. However, when the bushing 72 is lifted off the seat 76 by the lever 66, the valve 70 is opened and allows fuel and coloring agent to flow towards the outlet nozzle 45 and the ignition means 60.

Furthermore, in the context the present invention, in order to obtain a flame of suitable color, it has been found that the height of the flame (which depends on the flow rate of the fluid) must correspond to a well controlled transport flow density for the fluid, i.e. to a well controlled ratio Q/S expressed in units of $g/s.m^2$ (where Q represents fluid flow rate expressed in grams per second (g/s) and S represents the flow section of the fluid in square metros ($m^2$)).

More precisely still, it has thus been found that in order to obtain an acceptable height, it is preferable for the flow density to lie within plus or minus 25% of a target value of about 1.17 $g/s.m^2$, giving a flow density lying in the range 0.6 $g/s.m^2$ to 1.5 $g/s.m^2$.

Various embodiments of suction generating systems 100 suitable for use in the context of the present invention are described below with reference to FIGS. 3 to 13.

Firstly it is recalled that the suction generating system 100 is provided to guarantee full combustion of the mixture of fuel and coloring agent, and for this purpose to supply sufficient oxygen to the fuel leaving the nozzle of the lighter so that combustion is complete and so that no liquid is squirted out.

As can be seen in FIGS. 5 to 13, the bushing 72 of the venturi effect pump 100 is preferably formed by assembling together two tubes 110 and 150.

The upstream tube 110 has a through central channel 112 centered on an axis O-O. At its end adjacent to the seat 76, the channel 112 can be enlarged in the form of a chamber 114 adapted to receive a sealing gasket for bearing at rest against said seat 76 so as to ensure that the valve 70 is leak-proof.

In a variant, the sealing gasket can be secured to the seat 76 instead of to the tube 110.

The tube 110 also has a lateral orifice 116 which opens out into the central channel 112.

The purpose of the orifice 116 is to allow the fuel coming from the capillary 50 to penetrate into the channel 112 in spite of the presence of the sealing gasket provided at the end of the tube 110.

Downstream from this orifice 116, the tube 110 has a shoulder 118 projecting from its outside surface. This shoulder 118 is designed to provide a bearing point for the spring 74 which urges the tube 110 to close the valve 70 at rest.

Downstream from the shoulder 118, the tube 110 is provided with a groove 120 in its outside surface. This groove 120 is designed to receive a fork associated with the lever 66 to raise the tube 110 and open the valve 70 when the lever 66 is actuated.

At its downstream end, the tube 110 is terminated by converging portion 122. This preferably possesses a conical half-angle or half-angle at the center of about 21°.

The downstream tube 150 likewise possesses a through channel 152.

The downstream tube 150 is adapted to be engaged in leak-proof manner on the downstream end of the upstream tube 110 so that the two channels 112 and 152 lie on the same axis.

The downstream tube 150 possesses at least one through a radial orifice 154 opening out into the central channel 152 downstream from the converging portion 122. This orifice 154 is designed to suck in air due to the suction created in the pump body 100 at the outlet from the converging portion 122.

By way of non-limiting example, such a venturi effect pump 100 can have four inlet orifices 154 uniformly distributed around its axis O-O in order to suck in air.

Figure 5:
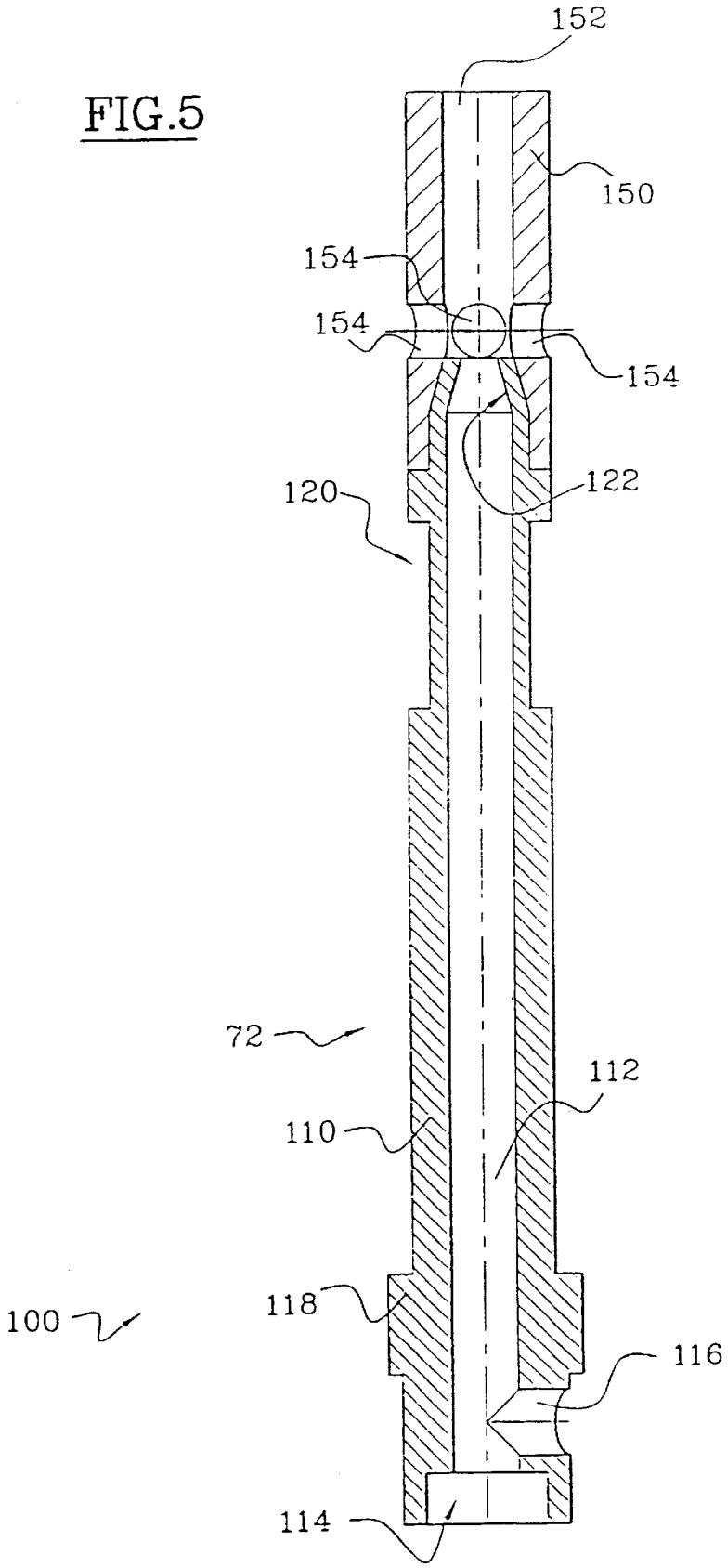
FIGS. 5 to 13 are longitudinal section views of a venturi effect pump suitable for use in the context of the present invention, with FIGS. 10 to 13 being enlarged views more particularly of the converging zone of such a pump.

In the embodiment shown in FIG. 5, the outlet channel 152 defined by the tube 150 is rectilinear and of constant right section.

Figure 6:
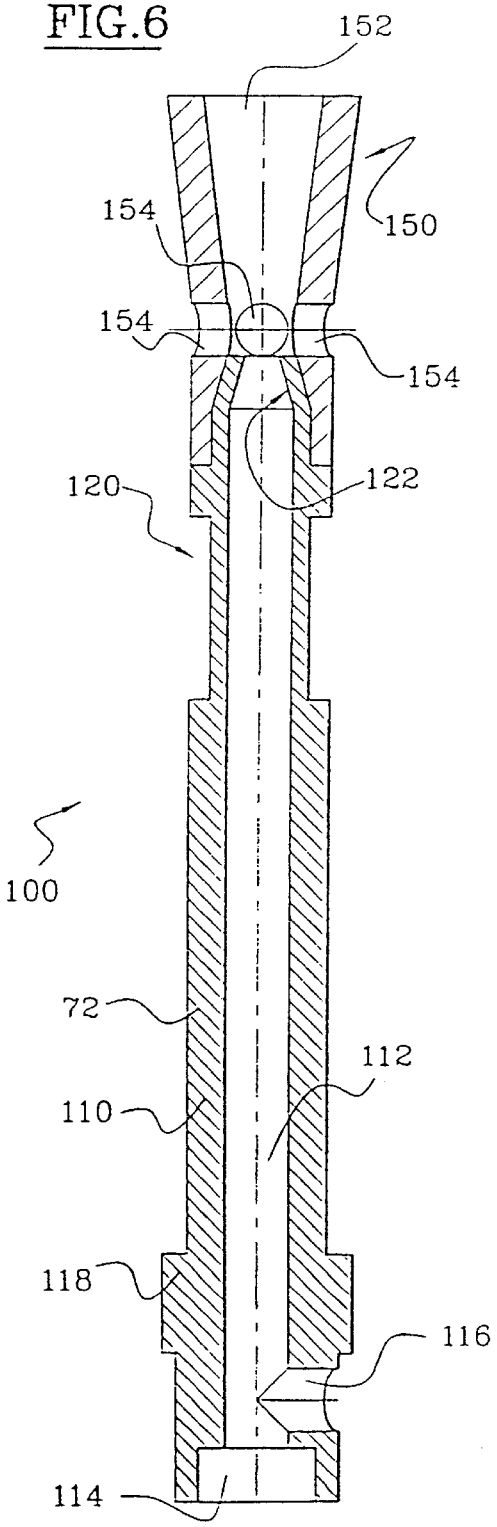

In contrast, in the embodiment shown in FIG. 6, the outlet channel 152 defined by the tube 150 is of the conical type diverging towards the outlet. The conical half-angle of the diverging portion 152 is typically about 70.

In the embodiments shown in FIGS. 5 and 6, the porous expander element 40 is placed in the capillary 50, i.e. upstream from the tube 72.

Figure 7:
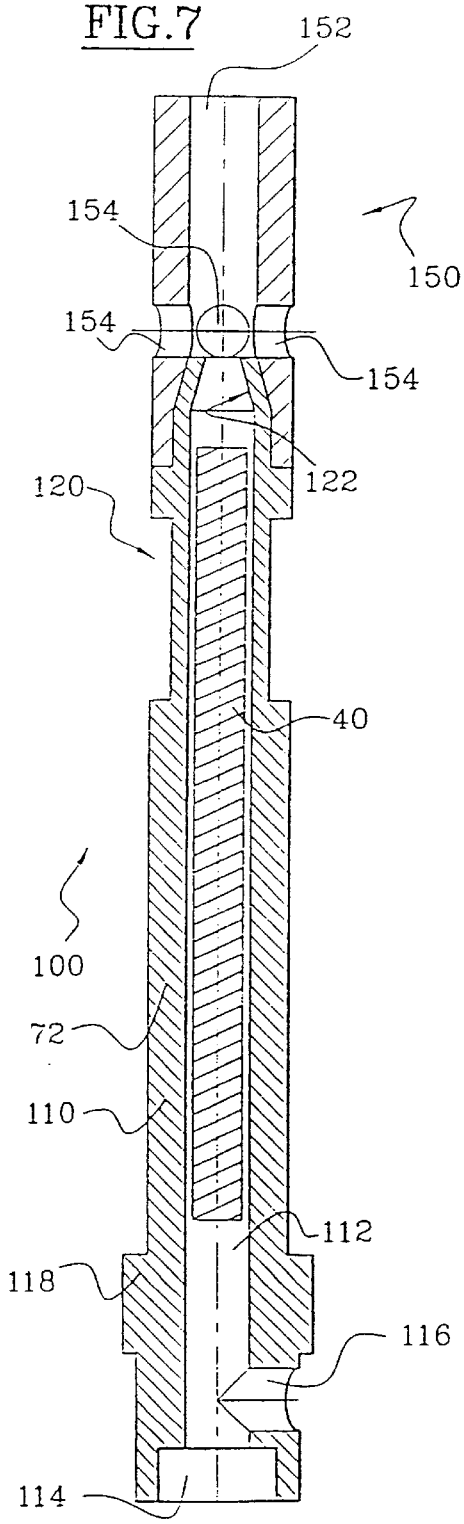
Figure 8:
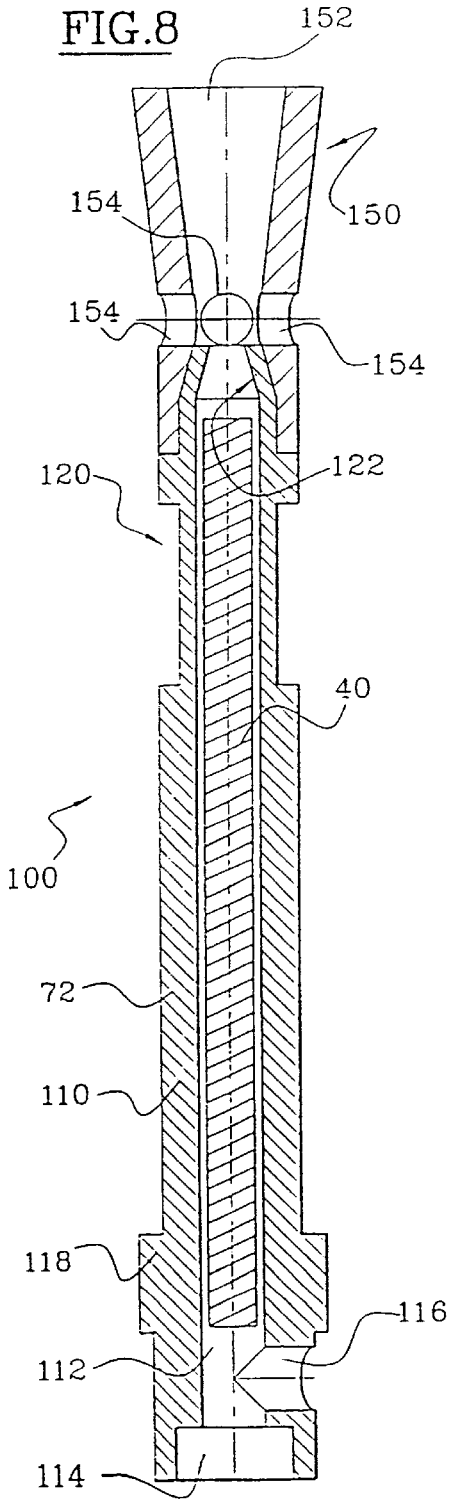

However, in the embodiments shown in FIGS. 7 and 8, of shapes that correspond respectively to those described above with reference to FIGS. 5 and 6 (in FIG. 7 the outlet channel 152 is a rectilinear, whereas in FIG. 8 it is divergent), the expander element 40 is shaped as a cylinder housed in the channel 112 between the shoulder 118 and the converging portion 122.

Figure 9:
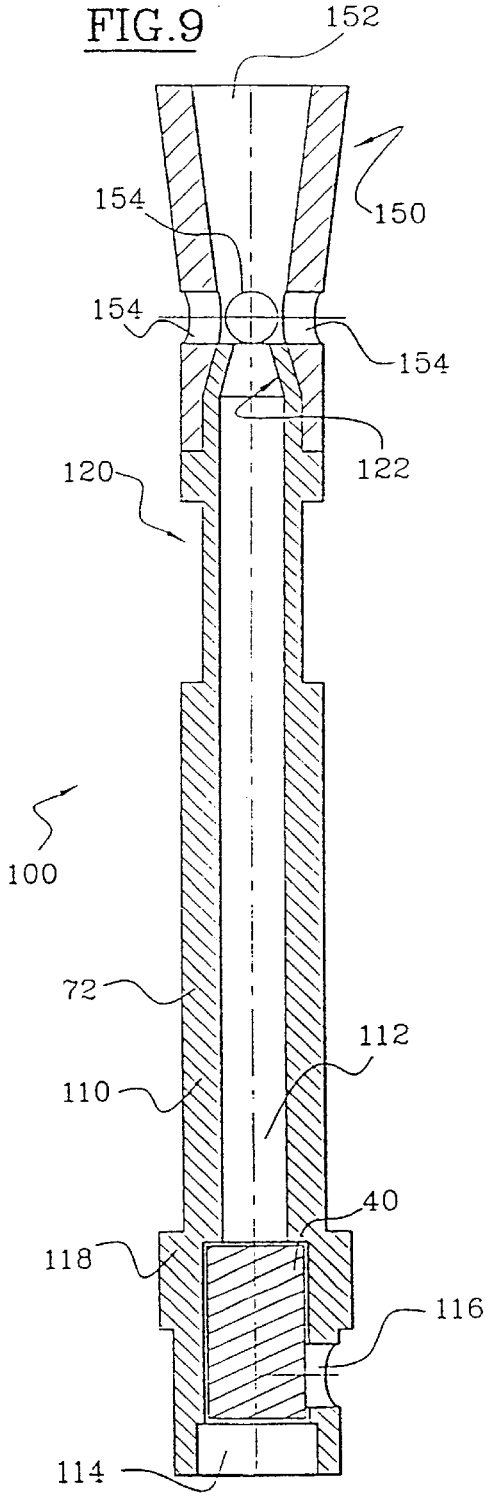

FIG. 9 shows a variant embodiment having an expander element 40 of limited length which is placed in the channel 112 facing the lateral inlet orifice 116. FIG. 9 has a diverging outlet channel. However, such a variant having an expander element 40 in register with the inlet orifice 116 can also be applied to a pump 100 having an outlet channel 152 of the cylindrical type.

FIGS. 10 to 13 show four other variant embodiments in which the expander element 40 is formed by an element of limited length housed in the tube 110 immediately upstream from the converging portion 122. Nevertheless, in a variant it is possible to use the nozzle and converging portion shapes shown in FIGS. 10 to 13 without an expander element 40, in which case the expander element is placed upstream from the means shown in FIGS. 10 to 13.

Figure 10:
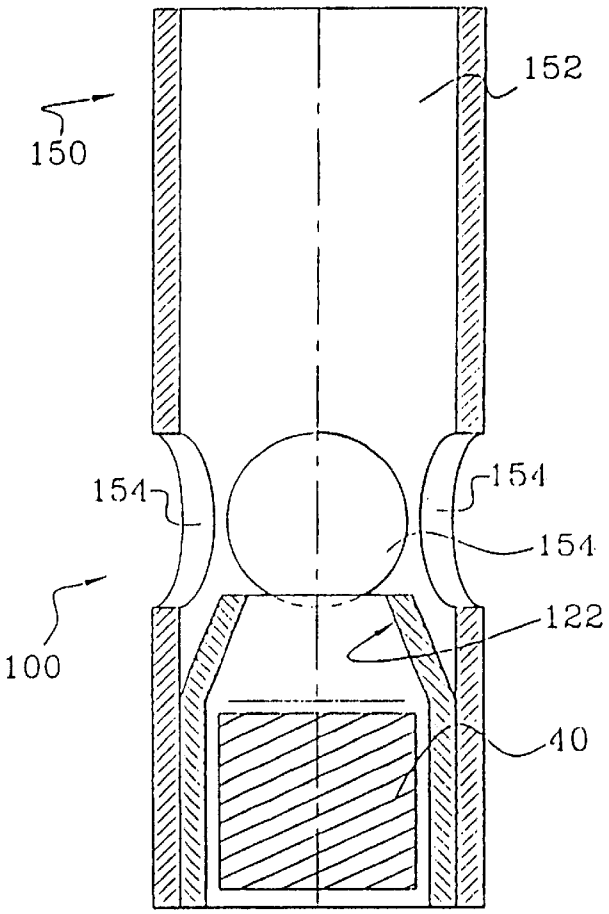

FIG. 10 shows an embodiment with a simple converging portion 122 and a rectilinear outlet channel 152.

Figure 11:
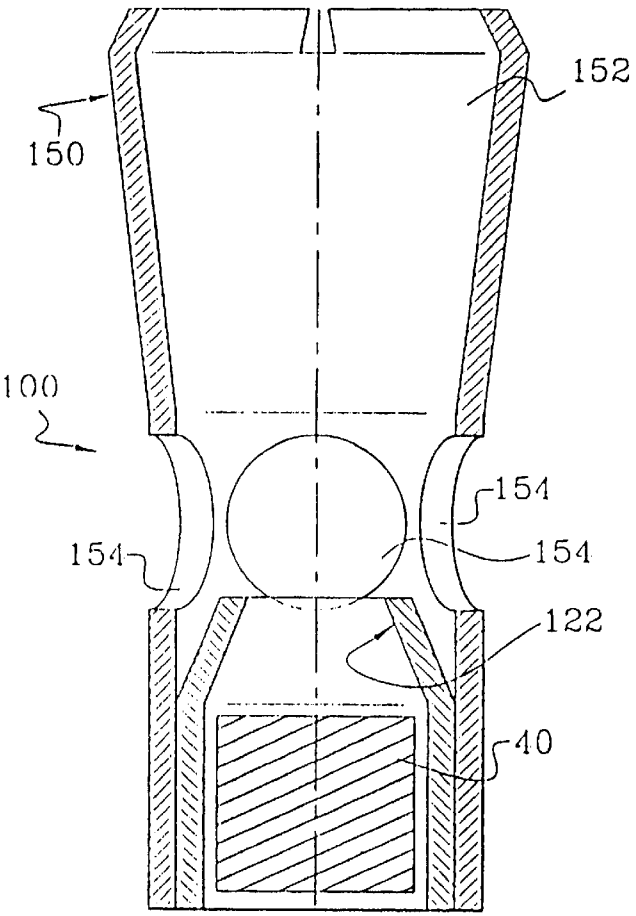

FIG. 11 shows a variant in which the outlet channel 152 is essentially diverging, but nevertheless possesses an end segment at its outlet which is of the converging type.

Figure 12:
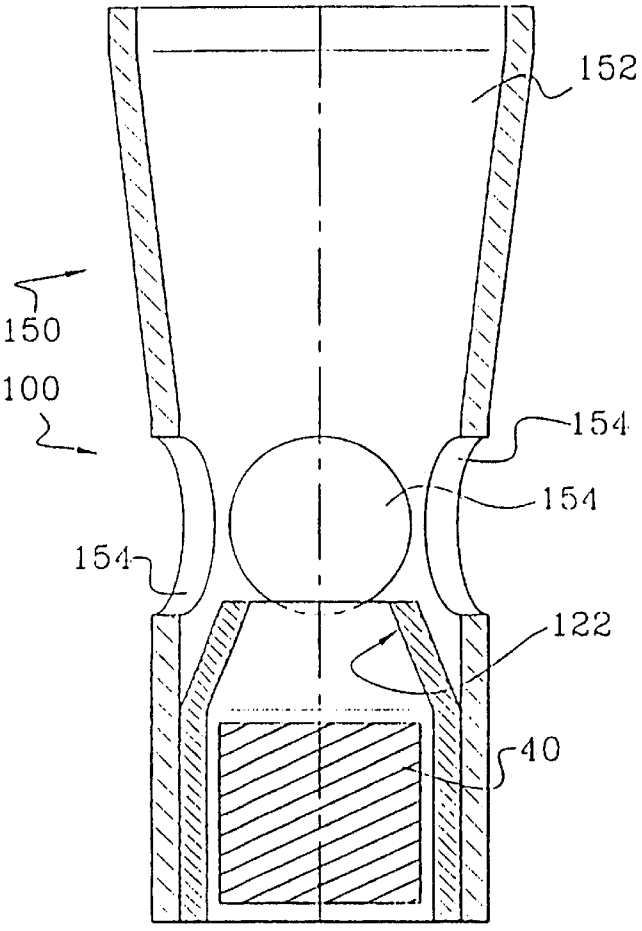

FIG. 12 shows another variant in which the outlet channel 152 is essentially diverging, but nevertheless possesses an end segment at its outlet which is of the cylindrical type.

Figure 13:
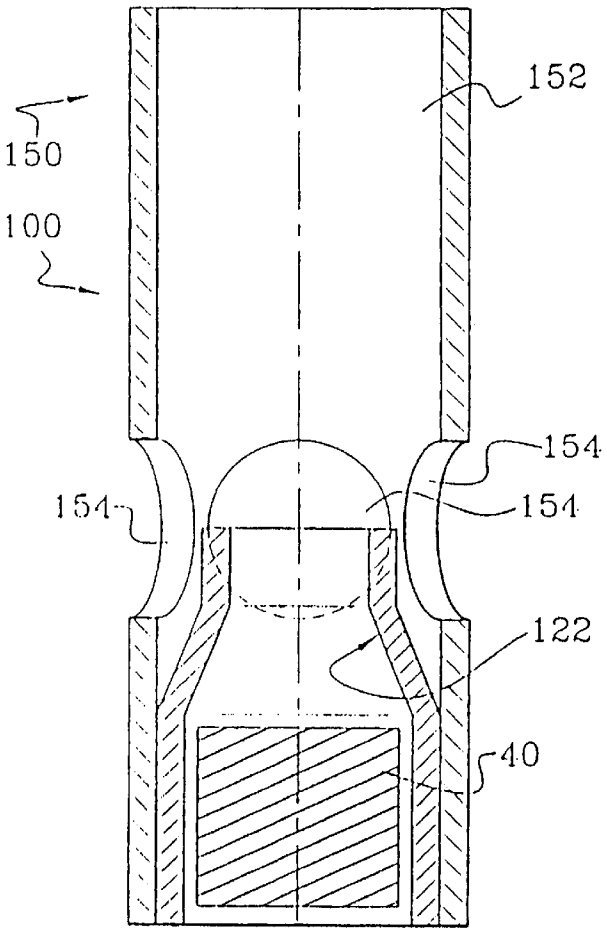

FIG. 13 shows a variant in which the outlet channel is cylindrical and of constant section, but the converging portion 122 is extended by an end segment 124 which is of the circularly cylindrical type.

Naturally, is possible to envisage other combinations of the various configurations shown in the accompanying figures.

Typically:

- the height H between the outlet orifice from the bushing 72 or downstream tube 150 and the base of the air inlet orifices 154 lies in the range 0.5 mm to 4 mm, and is advantageously about 1.5 mm;
- the diameter d of the orifices 154 lies in the range 0.2 mm to 0.9 mm;
- the diameter of the inlet orifice 116 and of the channel 112 is about 0.9 mm;
- the outlet diameter of the converging portion 122 is about 0.33 mm; and
- the diameter of the outlet channel 152 is greater than or equal to 1 mm.

When the valve 70 is open, the coloring agent mixed with the fuel 30 and conveyed by the capillary 50 passes through the expander element 40 and is ignited at the outlet from the nozzle 45 by the means 60. Because of the supply of oxygen delivered by the venturi effect pump 100, combustion of the basic fuel (preferably butane) is complete, as described above, and therefore does not generate any parasitic color. Thus, the resulting flame is colored by combustion of the coloring agent conveyed by the fuel.

Naturally, the present invention is not limited to the embodiments described above, but extends to any variant within the spirit of the invention.

What is claimed is:

1. A lighter for generating a flame of controlled color, the lighter comprising:

- a tank adapted to receive a fuel associated with flame coloring agents,
- a porous expander means suitable for expanding the fuel, the expander means having an average pore size less than about one micron, said expander means comprising a material that is hydrophobic, organophobic and inorganophobic, whereby constriction of fuel through the expander means is substantially prevented;
- means suitable for conveying the fuel to the expander means; and
- means suitable for igniting the fuel downstream from the expander means at an ignition zone.

2. The lighter according to claim 1, further comprising upstream from the ignition zone, a venturi effect pump which has a converging portion that is fed with fuel coming from the tank and which is adapted to premix oxygen with the fuel.

3. The lighter according to claim 1, wherein the expander means comprises a thermoplastic material.

4. The lighter according to claim 1, wherein the expander means comprises a non-polar material.

5. The lighter according to claim 1, wherein the expander means comprises a fluorine-containing polymer.

6. The lighter according to claim 1, wherein the expander means comprises polytetrafluoroethylene.

7. The lighter according to claim 1, wherein the expander means comprises polyolefin.

8. The lighter according to claim 1, wherein the expander means is formed by a nozzle of calibrated dimensions.

9. The lighter according to claim 1, wherein the expander means is adapted to control a flow rate of fuel and associated coloring agent upstream from the ignition point, said flow range being in the range 2 m/s to 8 m/s.

10. The lighter according to claim 1, and further comprising, downstream from of the fuel outlet, a cap having an orifice of calibrated size placed in register with the fuel outlet to reduce a fuel outlet speed and thus prevent the flame from being blown away, thereby a stabilizing the flame.

11. The lighter according to claim 2, wherein the venturi effect pump is adapted to supply an amount of oxygen corresponding to about one 10th of an oxygen flow rate necessary for complete combustion.

12. The lighter according to claim 1, wherein the means suitable for conveying the fuel to the expander means is constituted by a capillary.

13. The lighter according to claim 12, wherein the diameter of the capillary lies in a range 0.2 mm to 0.9 mm.

14. The lighter according to claim 1, and further comprising a valve provided upstream from the expander means.

15. The lighter according to claim 1, and further comprising a valve provided downstream from the expander means.

16. The lighter according to claim 1, and further comprising means suitable for defining a flow density lying in a range of 0.6 $g/s.m^2$ to 1.5 $g/s.m^2$.

17. The lighter according to claim 2, wherein the venturi effect pump comprises a body which possesses a through central channel and a lateral orifice which opens out into the central channel.

18. The lighter according to claim 2, wherein the body of the venturi effect pump constitutes a valve member.

19. The lighter according to claim 2, wherein the venturi effect pump has a converging portion which possesses a conical half-angle or half-angle at the center of about 21°.

20. The lighter according to claim 2, wherein an outlet channel of the venturi effect pump is rectilinear and of constant right section.

21. The lighter according to claim 2, wherein an outlet channel of the venturi effect pump is divergent towards the outlet.

22. The lighter according to claim 21, wherein a conical half-angle of the diverging portion is about 7°.

23. The lighter according to claim 12, wherein the expander means is made of a porous material and is placed in the capillary.

24. The lighter according to claim 1, wherein the expander means is made of a porous material and placed in the body of a venturi effect pump.

25. The lighter according to claim 2, wherein a height (H) between an outlet orifice of the venturi effect pump and a base of air inlet orifices lies in a range between 0.5 mm to 4 mm.

26. A lighter for generating a flame of controlled color, the lighter comprising:

a tank adapted to receive a fuel associated with flame coloring agents, a porous expander suitable for expanding the fuel and having an average pore size less than about one micron, the expander comprising a hydrophobic, organophobic, inorganophobic material, whereby constriction of fuel through the expander is substantially prevented;

a conduit for conveying the fuel to the expander; and an igniter downstream from the expander at an ignition zone and adapted to ignite the fuel.

27. A lighter for generating a flame of controlled color, the lighter comprising:

a tank adapted to receive a fuel associated with flame coloring agents, a porous expander suitable for expanding the fuel and having an average pore size less than about one micron, the expander comprising a material selected from the group consisting of polyolefin and fluorinated polyolefins, whereby constriction of fuel through the expander is substantially prevented;

a conduit for conveying the fuel to the expander; and an igniter downstream from the expander at an ignition zone and adapted to ignite the fuel.

* * * * *